US008181818B2

(12) United States Patent
Perell et al.

(10) Patent No.: US 8,181,818 B2
(45) Date of Patent: May 22, 2012

(54) SECURE CONTAINER WITH PRESSURE RESPONSIVE CONDUIT FOR CLOSURE DISRUPTION

(75) Inventors: William S. Perell, San Francisco, CA (US); David Z. Dytchkowsky, Appleton, WI (US)

(73) Assignee: PopPack, LLC, San Francisco, CA (US)

( * ) Notice: Subject to any disclaimer, the term of this patent is extended or adjusted under 35 U.S.C. 154(b) by 1191 days.

(21) Appl. No.: 11/732,818

(22) Filed: Apr. 5, 2007

(65) Prior Publication Data

US 2007/0284375 A1 Dec. 13, 2007

Related U.S. Application Data

(60) Provisional application No. 60/790,722, filed on Apr. 11, 2006.

(51) Int. Cl.

| | |
|---|---|
| ***A47G 19/22*** | (2006.01) |
| ***A45C 13/10*** | (2006.01) |
| ***B65D 75/00*** | (2006.01) |
| ***B65D 53/00*** | (2006.01) |

(52) U.S. Cl. ..... 220/720; 206/1.5; 206/807; 220/232

(58) Field of Classification Search ..... 220/720, 220/530, 202, 214, 215, 232, 281, 233, 203.19, 220/231, 234, 237, 239, 260, 261; 454/184; 206/1.5, 807; 53/85, 98, 403, 405, 86

See application file for complete search history.

(56) References Cited

U.S. PATENT DOCUMENTS 2,916,886 A 12/1959 Robbins 3,074,544 A 1/1963 Bollmeier et al.

(Continued)

FOREIGN PATENT DOCUMENTS

DE 20314741 1/2004

(Continued)

OTHER PUBLICATIONS

U.S. Appl. No. 12/434,254, filed May 1, 2009, Package with one or More Access Points for Breaking one or more Seals and Accessing the Contents of the Package.

(Continued)

*Primary Examiner* — Bryon P. Gehman
*Assistant Examiner* — Shawn Braden

(57) ABSTRACT

Secure product container 10 has opposed closure shells 10P and 10A forming product chamber 10C. The shells may be separated into an open accessible state (see FIG. 1A), in which the closure shells are uncaptured and product 10G is accessible. The closure shells may be placed together in a closed state along closure interface 12C (see FIG. 1B), in which the closure shells are captured to enclose the product. A closure capture between the closure shells holds the shells in the closed state. Closure capture 26 has a secured condition (see FIG. 2B) in which the closure shells are captured together in the closed state, and a released condition (see FIG. 2A) in which the closure shells may be uncaptured in the accessible state. Capture release device 12 on active shell 10A is pressure responsive for releasing the closure capture from the secured condition into the released condition when pressurized. When depressurized, the release device permits the closure capture to be secure from the released condition into the secured condition. Pressure system 14 (shown in FIG. 1A) is in fluid communication with the release device for pressurizing the release device to release the closure capture and uncapture the closure shells. The pressure system also depressurizes the release device to permit securing the closure capture and capturing the closure shells.

33 Claims, 4 Drawing Sheets

U.S. PATENT DOCUMENTS

| | | | | |
|---|---|---|---|---|
| 3,120,336 | A | | 2/1964 | Whatley, Jr. |
| 3,189,227 | A | | 6/1965 | Hobbs et al. |
| 3,256,981 | A | | 6/1966 | Kurtz |
| 3,294,227 | A | | 12/1966 | Schneider et al. |
| 3,301,390 | A | | 1/1967 | Via, Jr. |
| 3,342,326 | A | | 9/1967 | Zackheim |
| 3,419,137 | A | | 12/1968 | Walck, III |
| 3,573,069 | A | | 3/1971 | Keller et al. |
| 3,608,709 | A | | 9/1971 | Pike |
| 3,635,376 | A | | 1/1972 | Hellstrom |
| 3,921,805 | A | | 11/1975 | Compere |
| 3,964,604 | A | | 6/1976 | Prenntzell |
| 4,275,840 | A | | 6/1981 | Staar |
| 4,301,923 | A | | 11/1981 | Vuorento |
| 4,402,402 | A | | 9/1983 | Pike |
| 4,424,914 | A | * | 1/1984 | Brown, Jr. ..... 220/261 |
| 4,485,920 | A | | 12/1984 | Skylvik |
| 4,511,052 | A | | 4/1985 | Klein et al. |
| D279,808 | S | | 7/1985 | Pharo |
| 4,540,089 | A | | 9/1985 | Maloney |
| 4,597,244 | A | | 7/1986 | Pharo |
| 4,610,684 | A | | 9/1986 | Knox et al. |
| 4,632,244 | A | | 12/1986 | Landau |
| 4,704,314 | A | | 11/1987 | Hsu et al. |
| 4,711,359 | A | | 12/1987 | White et al. |
| 4,759,472 | A | | 7/1988 | Strenger |
| 4,793,123 | A | | 12/1988 | Pharo |
| 4,798,288 | A | | 1/1989 | Holzner |
| 4,872,556 | A | | 10/1989 | Farmer |
| 4,872,558 | A | | 10/1989 | Pharo |
| 4,874,093 | A | | 10/1989 | Pharo |
| 4,890,744 | A | | 1/1990 | Lane, Jr. et al. |
| 4,918,904 | A | | 4/1990 | Pharo |
| 4,949,530 | A | | 8/1990 | Pharo |
| 4,961,495 | A | | 10/1990 | Yoshida et al. |
| 5,031,246 | A | * | 7/1991 | Kronenberger ..... 2/195.2 |
| 5,050,736 | A | | 9/1991 | Griesbach |
| 5,100,028 | A | | 3/1992 | Seifert |
| 5,114,004 | A | | 5/1992 | Isono et al. |
| 5,126,070 | A | | 6/1992 | Leifheit et al. |
| 5,131,760 | A | | 7/1992 | Farmer |
| 5,137,154 | A | | 8/1992 | Cohen |
| 5,207,320 | A | | 5/1993 | Allen |
| 5,215,221 | A | | 6/1993 | Dirksing |
| 5,272,856 | A | | 12/1993 | Pharo |
| 5,325,968 | A | | 7/1994 | Sowden |
| 5,373,966 | A | | 12/1994 | O'Reilly et al. |
| 5,427,830 | A | | 6/1995 | Pharo |
| 5,445,274 | A | | 8/1995 | Pharo |
| 5,447,235 | A | | 9/1995 | Pharo |
| 5,487,470 | A | | 1/1996 | Pharo |
| 5,492,219 | A | | 2/1996 | Stupar |
| 5,564,591 | A | | 10/1996 | Christine |
| 5,588,532 | A | | 12/1996 | Pharo |
| 5,638,971 | A | * | 6/1997 | Justesen ..... 215/228 |
| D386,074 | S | | 11/1997 | Pharo |
| 5,711,691 | A | | 1/1998 | Damask et al. |
| 5,775,491 | A | | 7/1998 | Taniyama |
| 5,792,213 | A | | 8/1998 | Bowen |
| 5,814,159 | A | | 9/1998 | Paley et al. |
| 5,824,392 | A | | 10/1998 | Gothoh |
| 5,865,309 | A | | 2/1999 | Futagawa et al. |
| 5,870,884 | A | | 2/1999 | Pike |
| 5,910,138 | A | | 6/1999 | Sperko et al. |
| 5,928,213 | A | | 7/1999 | Barney et al. |
| 5,944,709 | A | | 8/1999 | Barney et al. |
| 5,967,308 | A | | 10/1999 | Bowen |
| 6,001,187 | A | | 12/1999 | Paley et al. |
| 6,007,264 | A | | 12/1999 | Koptis |
| 6,036,004 | A | | 3/2000 | Bowen |
| 6,068,820 | A | | 5/2000 | De Guzman |
| 6,165,161 | A | | 12/2000 | York et al. |
| 6,198,106 | B1 | | 3/2001 | Barney et al. |
| 6,203,535 | B1 | | 3/2001 | Barney et al. |
| 6,468,377 | B1 | | 10/2002 | Sperko et al. |
| 6,491,159 | B2 | | 12/2002 | Shibata |
| 6,547,468 | B2 | | 4/2003 | Gruenbacher et al. |
| 6,644,489 | B2 | * | 11/2003 | Chang ..... 220/203.01 |
| 6,658,400 | B2 | | 12/2003 | Perell et al. |
| 6,692,150 | B2 | | 2/2004 | Hoshino |
| 6,726,364 | B2 | | 4/2004 | Perell et al. |
| 6,846,305 | B2 | | 1/2005 | Smith et al. |
| 6,935,492 | B1 | | 8/2005 | Loeb |
| 6,938,394 | B2 | | 9/2005 | Perell |
| 6,968,952 | B2 | | 11/2005 | Crevier et al. |
| 6,996,951 | B2 | | 2/2006 | Smith et al. |
| 7,004,354 | B2 | | 2/2006 | Harper |
| 7,051,879 | B2 | | 5/2006 | Ramet |
| 7,055,683 | B2 | | 6/2006 | Bourque et al. |
| 7,175,614 | B2 | | 2/2007 | Gollier et al. |
| 7,306,095 | B1 | | 12/2007 | Bourque et al. |
| 7,306,371 | B2 | | 12/2007 | Perell |
| 7,441,799 | B2 | * | 10/2008 | Enders et al. ..... 280/731 |
| 7,597,691 | B2 | | 10/2009 | Kawaguchi, et al. |
| 7,644,821 | B2 | | 1/2010 | Perell |
| 2001/0032850 | A1 | * | 10/2001 | Neuner ..... 220/232 |
| 2002/0150658 | A1 | | 10/2002 | Morrissette et al. |
| 2002/0170832 | A1 | | 11/2002 | Klair |
| 2003/0019781 | A1 | | 1/2003 | Kocher |
| 2004/0057638 | A1 | | 3/2004 | Perell et al. |
| 2004/0226848 | A1 | | 11/2004 | Dunn-Rankin |
| 2006/0023976 | A1 | | 2/2006 | Alvater et al. |
| 2006/0126970 | A1 | | 6/2006 | Perell |
| 2007/0235369 | A1 | | 10/2007 | Perell |
| 2007/0237431 | A1 | | 10/2007 | Perell |
| 2007/0284375 | A1 | | 12/2007 | Perell |
| 2007/0286535 | A1 | | 12/2007 | Perell |
| 2007/0295766 | A1 | | 12/2007 | Perell |
| 2008/0212904 | A1 | | 9/2008 | Perell |

FOREIGN PATENT DOCUMENTS

| | | | |
|---|---|---|---|
| EP | 00306207 | A1 | 3/1989 |
| EP | 00317130 | A1 | 5/1989 |
| EP | 0709302 | A1 | 5/1996 |
| FR | 2345363 | A1 | 10/1977 |
| GB | 2253605 | A | 9/1992 |
| JP | 04215927 | A | 8/1992 |
| JP | 7-8236 | | 7/1995 |
| JP | 2003146364 | | 5/1996 |
| JP | 11029176 | A | 2/1999 |
| JP | 2000255598 | A | 9/2000 |
| JP | 2002503187 | | 1/2002 |
| JP | 2002037327 | | 2/2002 |
| WO | WO 96/23700 | A1 | 8/1996 |
| WO | WO 02/083504 | A1 | 10/2002 |
| WO | WO 2004/100856 | A2 | 11/2004 |
| WO | WO 2005/022323 | A | 3/2005 |
| WO | WO 2005/077811 | A1 | 8/2005 |
| WO | WO2009-086344 | A1 | 7/2009 |
| WO | WO2009-086346 | A1 | 7/2009 |
| WO | WO2009-088759 | A1 | 7/2009 |

OTHER PUBLICATIONS

U.S. Appl. No. 12/704,914, filed Feb. 12, 2010 entitled Package Containing a Breachable Bubble in Combination with a Closure Device.

U.S. Appl. No. 12/703,947, filed Feb. 11, 2010, entitled Package with Unique Opening Device and Process for Forming Package.

International Search Report and Written Opinion for PCT/EP2007/054724, dated Feb. 18, 2008.

* cited by examiner

SECURE CONTAINER WITH PRESSURE RESPONSIVE CONDUIT FOR CLOSURE DISRUPTION

This application claims the benefit of provisional application Ser. No. 60/790,722, filed Apr. 11, 2006.

TECHNICAL FIELD

This invention relates to secure containers, and more particularly to such containers with internal pressure responsive conduits for releasing catches to open the container.

BACKGROUND

Heretofore products have been presented on store shelves in a sturdy clam type secure package. These clam packages commonly had opposing hard plastic shells, which were typically hinged. The shells came together to enclose a product, and were edge secured to form a protected chamber for the enclosed product. These clam type packages were difficult to open in order to discourage product tampering and theft. The purchaser needed a sharp instrument, or scissors, or heavy shears to cut through the hard shells and gain access to the product. These earlier packages were destroyed by the cutting during opening, and were unavailable for future storage of the product by the purchaser.

SUMMARY

It is therefore an object of this invention to provide a secure product container which may be opened fast without edged tools such as blades, scissors, shears etc. A pliant, shape-change conduit is provided within the container proximate the shell closure. The closure is disrupted by the shape-change within the conduit.

It is another object of this invention to provide such a secure product container which is easy to open employing modest user force. A multiple cycle pressure system provides a disrupting pressure which builds-up within the conduit. The user squeezes a small hand-operated bulb causing inflation of the conduit. The conduit expands and changes in shape causing the closure between the shells to disrupt.

It is a further object of this invention to provide such a secure product container which does not create sharp edges in the hard shell material during opening. Cutting hard plastic with a sharp edge tool can create even sharper residual or secondary edges in the plastic along both sides of the cut. The present secure container does not require an edged tool, and therefore no secondary edges are created. After opening, the present secure container has the same safe, smooth edges as before when the container was closed.

It is a further object of this invention to provide such a secure product container with functions as a post-purchase storage box. The present container is not cut or otherwise disabled during the opening, and remains pristine and available for post-purchase storage. The container may be closed and reused. The original manufacturer's container must be sturdy enough to withstand shipping, handling, long-term storage, and on-the-self security; and are highly suitable for user storage. The containers are typically attractively presented with model numbers, voltages etc suitably displayed, and brief instruction labels.

Briefly, these and other objects of the present invention are accomplished by providing a security container having opposed closure shells. The shells have a closed state in which the closure shells are captured along a closure shell interface to enclose a product, and an accessible state in which the closure shells are uncaptured and the product is accessible. A product chamber is provided within the closure shells. A closure capture between the closure shells has a secured condition in which the closure shells are captured together in the closed state, and a released condition in which the closure shells may be uncaptured in the accessible state. A capture release device pressure is responsive for releasing the closure capture from the secured condition into the released condition when pressurized. The release device permits the closure capture to be secured from the released condition into the secured condition when depressurized. A pressure system in fluid communication with the release device pressurizes the release device to release the closure capture and uncapture the closure shells. The pressure system depressurizes the release device to permit securing of the closure capture and capturing of the closure shells.

BRIEF DESCRIPTION OF THE DRAWINGS

Further objects and advantages of the present secure container and the operation of the release conduit will become apparent from the following detailed description and drawing (not drawn to scale) in which.

Figure 1A:
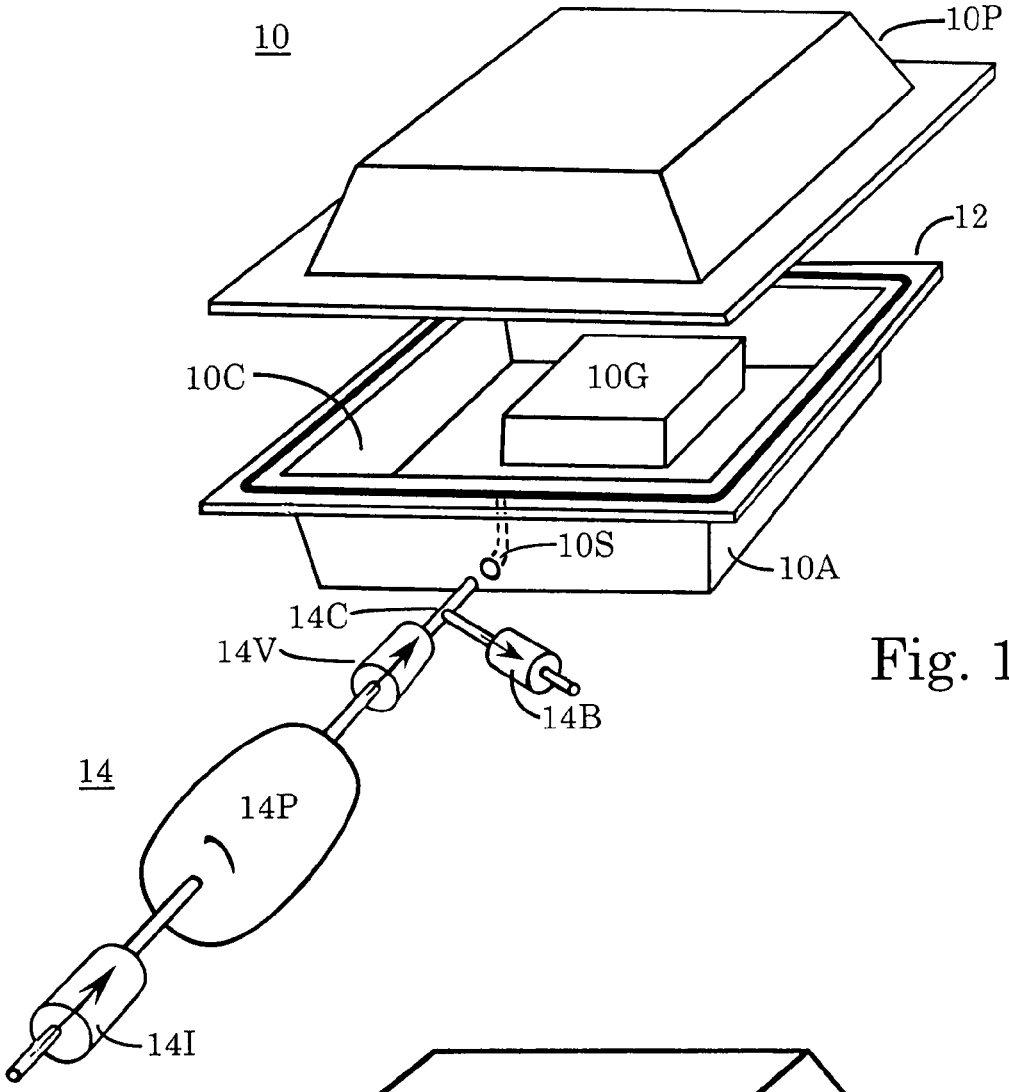
FIG. 1A is a perspective view of open product container 10 and pressure system 14, showing capture release device 12.

The first digit of each reference numeral in the above figures indicates the figure in which an element or feature is most prominently shown. The second digit indicates related elements or features, and a final letter (when used) indicates a sub-portion of an element or feature.

REFERENCE NUMERALS IN DRAWINGS

The table below lists the reference numerals employed in the figures, and identifies the element designated by each numeral.

| | |
|---|---|
| Secured Product Container | 10 |
| Active Closure Shell | 10A |
| Product chamber | 10C |
| Product | 10G |
| Passive Closure Shell | 10P |
| Shell Port | 10S |
| Capture release device | 12 |
| Closure Interface | 12C |

-continued

| | |
|---|---|
| Pressure System | 14 |
| Bleeder Valve | 14B |
| Pump Connector | 14C |
| One-way Intake Valve | 14I |
| Pressure Pump | 14P |
| One-way Valve | 14V |
| Secured Product Container | 20 |
| Active Closure Shell | 20A |
| Closure Interface | 20C |
| Hinge Bond | 20H |
| Passive Closure Shell | 20P |
| Hollow Conduit | 22 |
| Retainer Groove | 22R |
| Electric Pressure Pump | 24P |
| Start Button | 24E |
| Closure Capture | 26 |
| Capture Lip | 26A |
| Capture Lip | 26P |
| Capture Catch | 27A |
| Camming Face | 27F |
| Capture Catch | 27P |
| Return Clearance | 34R |
| Return Slot | 34S |
| Secured Product Container | 40 |
| Active Closure Shell | 40A |
| Product Chamber | 40C |
| Passive Closure Shell | 40P |
| Shell Pressure Port | 40S |
| Inner Conduit Seal | 42I |
| Outer Conduit Seal | 42O |
| Shell Vacuum Port | 40V |
| Pressure System | 44 |
| Accessory Compartment | 44A |
| One-way Intake Valve | 44I |
| Hinged Cover | 44H |
| Pressure Pump | 44P |
| Shaped Recesses | 44S |
| One-way Valve | 44V |
| Active Closure Shell | 50A |
| Passive Closure Shell | 50P |
| Bladder Release Device | 52B |
| Release Conduit | 62 |
| Closure Capture | 66 |
| Perimeter Groove | 66G |
| Perimeter Tongue | 66T |
| Closure Shell | 70A |
| Closure Shell | 70P |
| Release Conduit | 72 |
| Closure Capture | 76 |
| Resilient Prong | 76P |
| Holding Face | 77A |
| Hooking Face | 77P |

General Embodiment—(FIGS. 1AB)

Figure 1B:
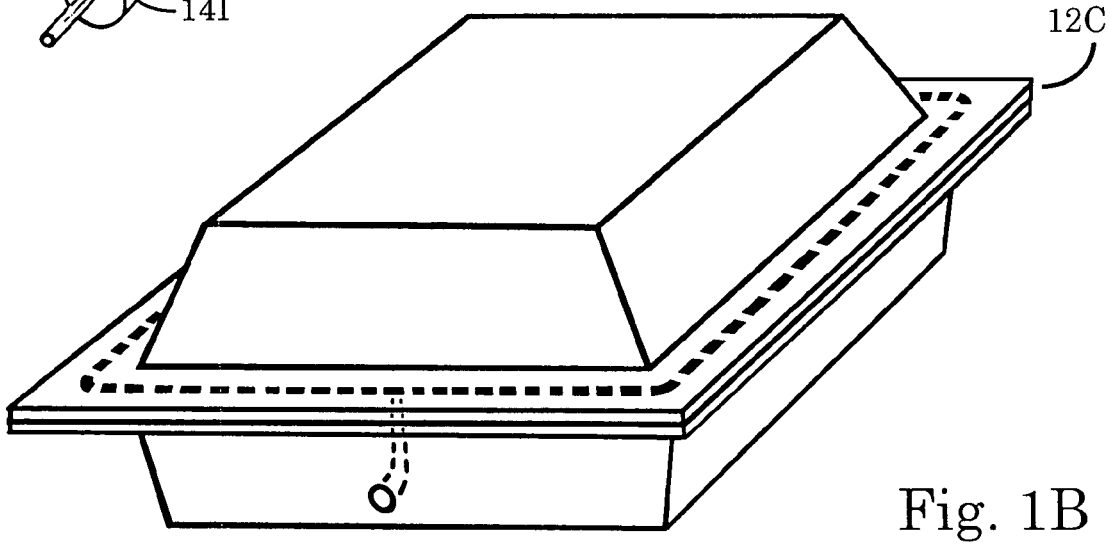
FIG. 1B is a perspective view of closed product container 10 showing closure interface 12C.

Secure product container 10 has opposed closure shells 10P and 10A. The shells may be separated into an open accessible state (see FIG. 1A), in which the closure shells are uncaptured and product 10G is accessible. The closure shells may be placed together in a closed state along closure interface 12C (see FIG. 1B), in which the closure shells are captured to enclose the product. Product chamber 10C within the closure shells displays and stores the product. The shells may be formed of the same material, or different materials, as required by the application. A closure capture between the closure shells holds the shells in the closed state. Closure capture 26 has:

- a secured condition (see FIG. 2B) in which the closure shells are captured together in the closed state, and
- a released condition (see FIG. 2A) in which the closure shells may be uncaptured in the accessible state.

Capture release device 12 on active shell 10A is pressure responsive for releasing the closure capture from the secured condition into the released condition when pressurized. When depressurized, the release device permits the closure capture to be secure from the released condition into the secured condition. Pressure system 14 (shown in FIG. 1A) is in fluid communication with the release device for pressurizing the release device to release the closure capture and uncapture the closure shells. The pressure system also depressurizes the release device to permit securing the closure capture and capturing the closure shells.

Pressure System—(FIG. 1A)

Figure 3B:
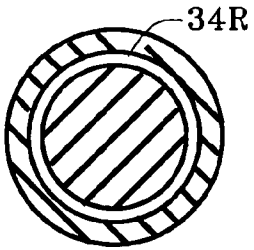
FIG. 3B is a sectional view of one-way valve 14V of FIG. 1A, showing return clearance 34R.
Figure 3A:
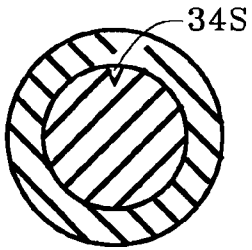
FIG. 3A is a sectional view of one-way valve 14V of FIG. 1A, showing return slot 34S for slowly leaking the pressure off capture release device 12.

Pressure system 14 for providing the release pressure may be external to, and detachable from, the opposed closure shells (as shown in FIG. 1A). Pump connector 14C provides fluid communication between pressure pump 14P and the capture release device. The pressure end of the pump connector, connects to and disconnects from shell port 10S on active shell 10A. One-way pressure valve 14V in the pump connector prevents return flow from the release device through the pump connector back to the pressure pump. The one-way valve defines a pump side and a pressure side within the pressure system, permitting the pressure on the pump side to build-up in release device 12 through multiple pump cycles. A bleeder mechanism on the pressure side may be employed to "bleed-off" or depressurize the built-up pressure after the release of the closure capture. The bleeder mechanism may be bleeder valve 14B which is shut during pressurization and open to the ambient after the release of the closure capture. Alternatively, the bleeder mechanism may be a return passage in the one-way valve for permitting the slow return or "leak" of pressure from the pressure side back to the pump side. The return passage may be a space or opening such as slot 34S in the one-way valve (see FIG. 3A), or a generous clearance 34R within the valve (see FIG. 3B).

The pressure pump may be a hand operated squeeze bulb having an exhaust-pump cycle followed by an intake-refill cycle, much like the squeeze bulb on a blood-pressure cuff. During the exhaust-pump cycle, the one-way pressure valve permits forward flow from the squeeze bulb pump to the release device. During the intake-refill cycle, the one-way valve prevents return flow from the release device back to the squeeze bulb pump. However, one-way intake valve 14I permits input flow from the ambient to refill the squeeze bulb. Each squeeze by the user causes an increase in the pressure build-up in the release device. One or more low effort pump cycles pressurizes the release device sufficiently to release the capture closure. The squeeze bulb may have an internal structural bias which causes the bulb to re-inflate during each intake-refill cycle in readiness for the next exhaust-pump cycle.

Figure 2A:
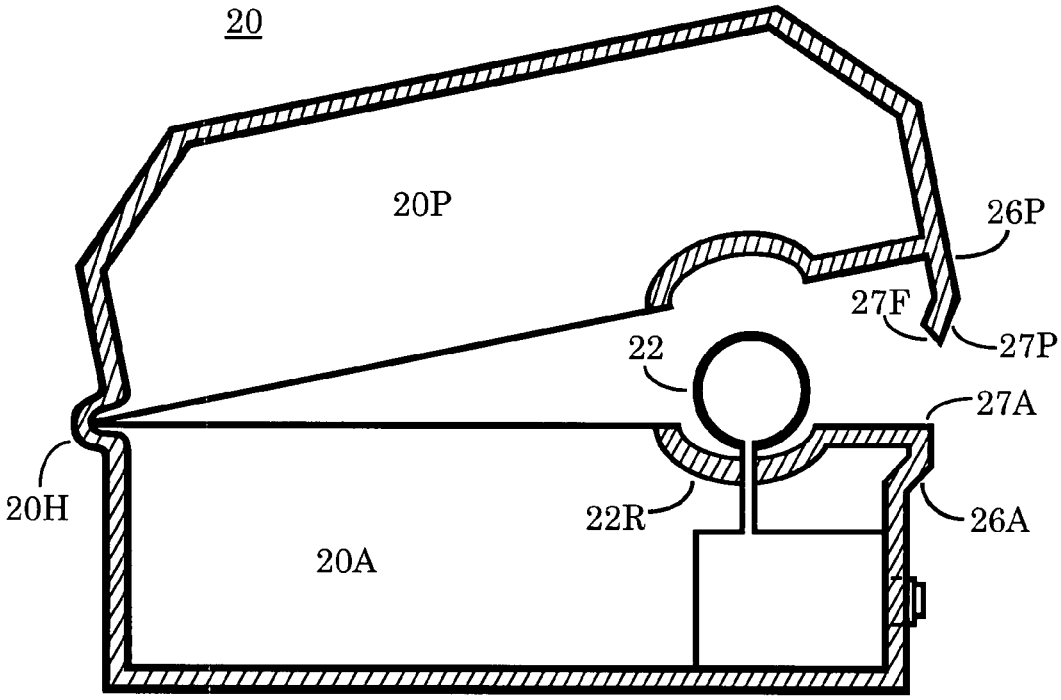
FIG. 2A is a side view in section of open product container 20 with hinge bond 20H.
Figure 2B:
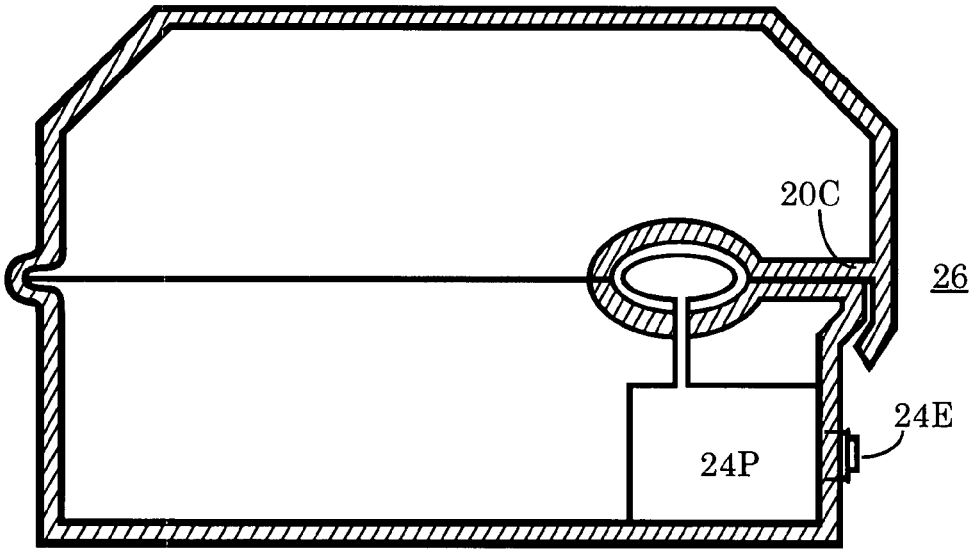
FIG. 2B is a side view in section of closed product container 20 with closure capture 26.

Capture Release Device—(FIGS. 2AB)

The capture release device undergoes a shape-change displacement when changing from depressurized to pressurized. This displacement releases closure capture 26, from the depressurized secured condition (see FIG. 2B) to the pressurized released condition (see FIG. 2A). The shape-change release device may be a pliant, hollow conduit 22 extending around at least a portion of the perimeter of shell closure interface 20C. The shape-change displacement may involve a change in cross-section of the release conduit, such as from out-of-round when depressurized to round when pressurized. Enclosed volumes under pressure tend to assume a configurations such as spheres and circles, which maximize the volume-to-surface ratio. A flexible, deformable tube which is flat or oval when relaxed under low pressure, becomes rigid and rounder when stressed under high pressure. A round conduit may shape-change by expanding in diameter. A curved tube may shape-change or displace into a straighter tube. A straight tube may displace into a longer straight tube. The release conduit may structurally biased toward out-of-round and mechanically return to out-of-round when depressurized. The bias maybe due to the mold or dye employed during manufacture, or may be due to internal molecular forces.

One of the opposed closure shells is active shell 20A and the other closure shell is passive shell 20P. The perimeter release conduit is installed on the active closure shell and pushes against the passive closure shell during the shape-change displacement to release the closure capture. A retainer structure such as groove 22R on the active closure shell retains the perimeter release conduit in an engaging position relative to the passive closure shell during the shape-change displacement.

Closure Capture—(FIGS. 2AB)

The opposed closure shells may detach into two uncoupled shells when in the accessible state (as shown in FIG. 1A). Alternatively, perimeter hinge bond 20H may connect closure shells 20A and 20P, defining a hinged portion of the perimeter and a non-hinged portion. The hinge bond permits the opposed shells to pivot between the accessible state (see FIG. 2A) and the closed state (see FIG. 2B), while remaining a one-piece component. Closure capture 26 extends along the non-hinged portion of the perimeter defining a non-hinged closure interface. The hinged closure shells are captured by the closure capture along the non-hinged closure interface. Hollow perimeter release conduit 22 extends along the non-hinged closure interface.

The closure capture may have an inside perimeter capture lip 26A with capture catch 27A on one closure shell, and an opposed outside perimeter capture lip 26P with cooperating capture catch 27P on the other closure shell. The capture lips overlap with a slight overbite and the cooperating catches engage when the closure shells are in the closed state. Camming face 27F guides overlapping capture lip 26A down over capture lip 26P as the opposed shells pivot into the closed state, to place the cooperating catches 27A and 27P into engagement.

As pliant release conduit 22 is pressurized, the cross-sectional shape changes from oval (see FIG. 2B) to round (see FIG. 2A). The change-in-shape pushes against the passive shell and overcomes the capture constraint of the catches. The shells separate into a slightly open position, from which they may be pivoted into the accessible state. The release pressure may be bled-off as described in connection with pressure system 14. The conduit may have internal memory forces which urge the conduit to return to the original depressurized oval shape.

In the embodiment of FIGS. 2AB, the pressure system is mounted internally within the opposed closure shells. Electric pressure pump 24P is permanently attached to active closure shell 20A, and is activated by start button 24E. The power source may be internal batteries or externally supplied electricity.

Figure 4:
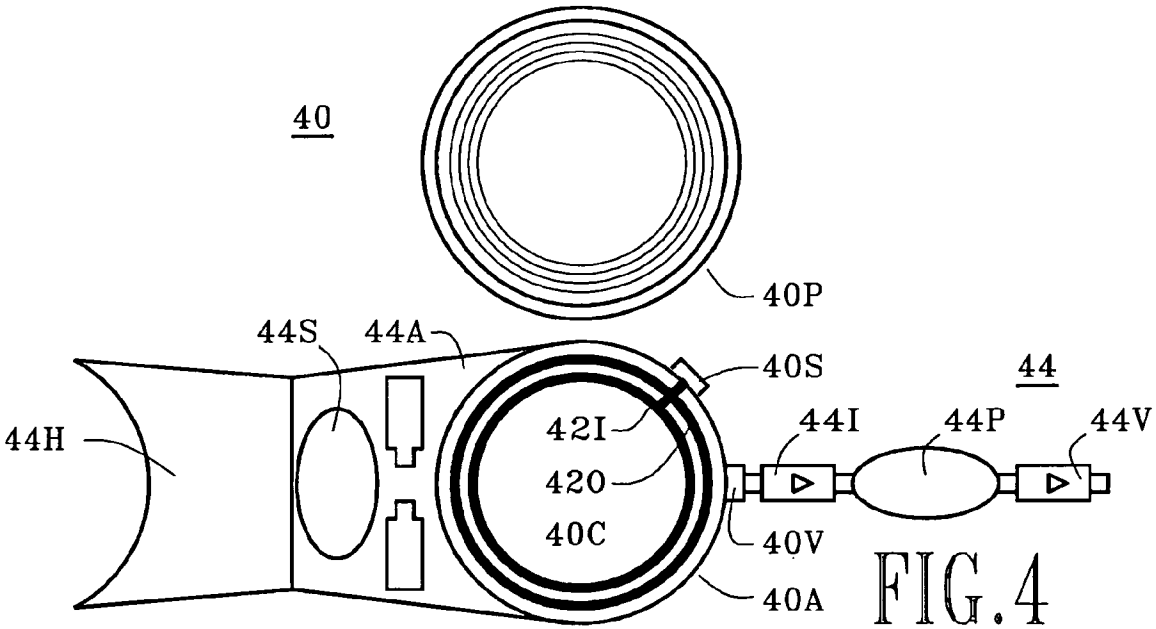
FIG. 4 is a plan view of open product container 40 and pressure system 44, showing double sealing loops 42O and 42I.

Product Chamber Seal—(FIG. 4)

The closure capture may extend completely around the perimeter of closure shells 40A and 40P (see FIG. 4) defining a perimeter closure interface enclosing product chamber 40C. The opposed closure shells are captured by the closure capture along the closure interface. A pliant perimeter release conduit may extend completely around the perimeter of the opposed closure shells providing a continuous loop dust gasket between the opposed closure shells. The pliant conduit may be sufficiently resilient to form a hermetic-like seal barrier between the opposed closure shells when in the closed state. The loop seal barrier may have two seals, outer seal conduit 42O and inner seal conduit 42I, forming a double loop seal barrier. The seal conduits and other release conduits may be suitable hollow, flexible lines, such as thin capillary type tubes.

Pressure system 44 pressurizes the capillaries causing an expansion shape change for releasing the closure capture. The pressure system may be reversed in operation, and/or connection for establishing the low pressure inside product chamber 40C (as shown in FIG. 4). Pressure one-way valve 44V may be removed from shell pressure port 40S and bulb intake valve 44I installed on shell vacuum port 40V. Pump 44P is then employed for establishing the low pressure within the product chamber when the opposed closure shells are in the closed state. The low internal pressure pulls the closure shells into tighter closure and presses the seals into tighter sealing. Each squeeze cycle of the pump removes air from the product chamber out to the ambient. A dust-proof, sealed, low pressure product chamber provides a highly suitable environment for delicate instruments such as camera, laptops, microscopes etc. The breaking of the seal may be accompanied by sound, such as cracking or popping, which indicates that the seal has been separated and the shells may be separated. The squeeze bulb pump may be a small "thumb" pump stored in accessory compartment 44A. Shaped recesses 44S in the compartment hold the pressure system.

Figure 5:
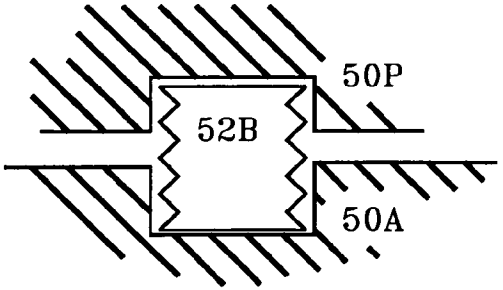
FIG. 5 is a fragmentary side view in section of expanding bladder 52B.

In a resealable embodiment, the product may be returned to the package and the shells pressed closed, for long-term reusable storage. The closing pressure deflates the capillary and the package closure is restored. The diameter and length of the capillary tubes may be bigger and longer for stronger and larger packages Bladder Embodiment—(FIG. 5)

The shape-change release device may be bladder 52B which undergoes an expansion shape-change displacement when pressurized to push against shells 50A and 50P, releasing the closure capture. The bladder then shrinks when depressurized to permit the securing of the closure capture.

Figure 6:
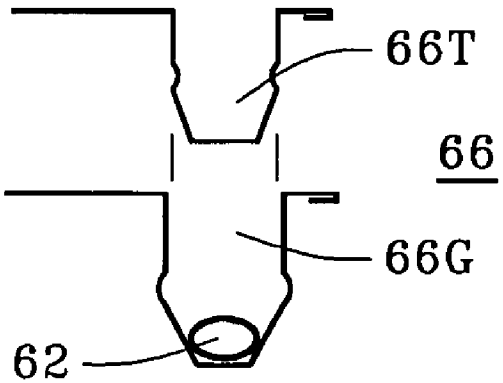
FIG. 6 is a fragmentary side view of a tongue-in-groove closure capture 66.

Tongue and Groove Embodiment—(FIG. 6)

The closure capture may have a tongue-in-groove for sealing and securing the container. Perimeter groove 66G extends along the perimeter closure and retains pliant release conduit 62 (see FIG. 6). Perimeter tongue 66T frictionally engages the groove to establish the secured condition when the shells are in the closed state. The tongue disengages from the groove in response to the shape-change of the pliant release conduit. The tongue and groove may be rippled to enhance the secure condition.

Figure 7:
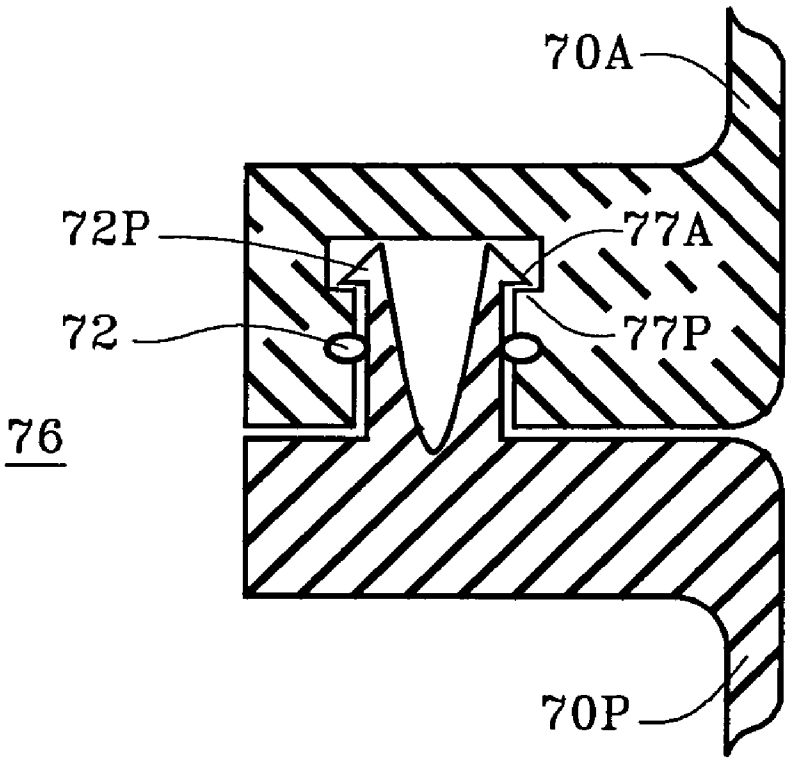
FIG. 7 is a side view in section of closure capture 76 showing resilient prongs 76P.

Prong Closure Capture—(FIG. 7)

The closure capture may be at least one discrete closure latch 76 (see FIG. 7), having a latched condition in which the closure shells 70A and 70P are captured together in a closed state, and an unlatched condition in which the closure shells may be uncaptured in an accessible state. Resilient prong 76P with hooking face 77P extends from passive closure shell 70P. Holding face 77A formed on active closure shell 70A engages the hooking face when the discrete latch is in the latched condition. Shape-change release conduit 72 is installed on the active closure shell and pushes against the resilient prong during the shape-change displacement. The release conduit expands toward the resilient prong and displaces the prong, disengaging the hooking face from the holding face. The capture release conduit undergoes a shape-change displacement when changing from depressurized to pressurized. The displacement releases the closure latch from the latched condition to the unlatched condition.

A plurality of discrete closure latches may be positioned around the perimeter of the opposed closure shells. A pair of opposed resilient prongs maybe are installed on the passive shell, pressing against a pair of opposed capillary tubes are installed on the active shell. The shells are pressed together to lock the prongs and reseal the shells. The engagement between the hooking face and the holding face may exert a camming pull which draws the shells closer together along the edge seal.

INDUSTRIAL APPLICABILITY

It will be apparent to those skilled in the art that the objects of this invention have been achieved as described hereinbefore by providing a secure product container which may be opened without edged tools. A shape-change conduit is provided within the container proximate the shell closure which disrupts the closure. The secure container which is easy to open employing a simple bulb pump. Secondary sharp edges are not created during the opening of the container. The user may employ the product container as a post-purchase storage box.

CONCLUSION

Various changes may be made in the structure and embodiments shown herein without departing from the concept of the invention. Further, features of embodiments shown in various figures may be employed in combination with embodiments shown in other figures. Therefore, the scope of the invention is to be determined by the terminology of the following claims and the legal equivalents thereof.

We claim as our invention:

1. Product security container, comprising:

opposed closure shells having a closed state in which the closure shells are captured along a closure shell interface to enclose a product, and an accessible state in which the closure shells are uncaptured and the product is accessible;

product chamber provided within the opposed closure shells;

closure capture between the closure shells having a secured condition in which the closure shells are captured together in the closed state, and a released condition in which the closure shells may be uncaptured in the accessible state;

a retainer groove defined in one of the opposed closure shells generally adjacent to the closure shell interface;

capture release device pressure responsive for releasing the closure capture from the secured condition into the released condition when pressurized, and for permitting the closure capture to be secured from the released condition into the secured condition when depressurized, the capture release device at least partially disposed in the retainer groove; and pressure system in fluid communication with the release device for pressurizing the release device to release the closure capture and uncapture the closure shells, and for depressurizing the release device to permit securing of the closure capture and capturing of the closure shells.

2. The container of claim 1, wherein the capture release device undergoes a shape-change displacement when changing from depressurized to pressurized, which displacement releases the closure capture from the secured condition to the released condition.

3. The container of claim 2, wherein the shape-change displacement involves a change in cross-section of the release device.

4. The container of claim 3, wherein the change in cross-section is from out-of-round when depressurized to round when pressurized.

5. The container of claim 4, wherein the shape-change release device is structurally biased toward out-of-round and returns to out-of-round when depressurized.

6. The container of claim 2, wherein the shape-change release device is a bladder which undergoes an expansion shape-change displacement when pressurized to release the closure capture, and which shrinks when depressurized to permit the securing of the closure capture.

7. The container of claim 2, wherein the shape-change release device is pliant and extends around at least a portion of the perimeter of the closure shell interface.

8. The container of claim 7, wherein one of the opposed closure shells is an active closure shell and the other closure shell is a passive closure shell; and the perimeter release device is installed on the active closure shell and pushes against the passive closure shell during the shape-change displacement to release the closure capture.

9. The container of claim 8, wherein the retainer groove is defined in the active closure shell.

10. The container of claim 7, further comprising a perimeter hinge connecting the opposed closure shells defining a hinged portion of the perimeter and a non-hinged portion of the perimeter, permitting the opposed shells to pivot between the closed state and the accessible state.

11. The container of claim 10, wherein:

the closure capture extends along the non-hinged portion of the perimeter defining a non-hinged closure interface;

the hinged opposed closure shells are captured by the closure capture along the non-hinged closure interface; and the pliant release devise extends proximate the non-hinged closure interface.

12. The container of claim 7, wherein the opposed closure shells are uncoupled shells when in the accessible state.

13. The container of claim 12, wherein: the closure capture extends completely around the perimeter of the closure shells defining a closure interface; the opposed closure shells are captured by the closure capture along the closure interface; and the pliant release devise extends proximate the closure interface.

14. The container of claim 7, wherein the closure capture extends along a perimeter closure interface; the opposed closure shells are captured along the perimeter closure interface; and the pliant release devise extends proximate the perimeter closure interface.

15. The container of claim 14, wherein the closure capture further comprises: a perimeter groove for retaining the pliant release devise; and a perimeter tongue which frictionally engages the perimeter groove to establish the secured condition, and which disengages from the perimeter groove in response to the shape-change of the pliant release devise.

16. The container of claim 14, wherein the closure capture further comprises: an inside perimeter capture lip with a capture catch on one closure shell; and an opposed outside perimeter capture lip with a cooperating capture catch on the other closure shell; which capture lips overlap and the cooperating capture catches engage when the closure shells are in the closed state.

17. The container of claim 15, wherein the overlapping capture lips further comprises a camming face for guiding the cooperating capture catches into engagement.

18. The container of claim 7, wherein the pliant release devise extends completely around the perimeter of the opposed closure shells, providing a continuous loop gasket between the opposed closure shells.

19. The container of claim 7, wherein the pliant release devise is sufficiently resilient to a change-in-shape to form a continuous loop seal barrier between the opposed closure shells when in the closed state.

20. The container of claim 19, wherein the continuous loop seal barrier has an outer loop and an inner loop, forming a double loop seal barrier between the opposed closure shells when in the closed state.

21. The container of claim 1, wherein the pressure system further comprises a pressure pump for providing the pressure to pressurize and depressurize the capture release device.

22. The container of claim 21, wherein the pressure pump is reversible in operation for establishing a low pressure within the product chamber when the opposed closure shells are in the closed state.

23. The container of claim 21, wherein the pressure pump is reversible in connection for establishing a low pressure within the product chamber when the opposed closure shells are in the closed state.

24. The container of claim 21, wherein the pressure pump is external to the opposed closure shells, and is detachable from the opposed closure shells.

25. The container of claim 21, wherein the pressure pump is internal to the opposed closure shells, and is permanently attached to the opposed closure shells.

26. The container of claim 21, wherein the pressure system further comprises:

a pump connector providing fluid communication between the pressure pump and the capture release device;

a one-way valve in the pump connector which prevents return flow through the pump connector back to the pressure pump, the one-way valve defining a pump side within the pressure system and a pressure side within the pressure system, and permitting the pressure on the pump side to build-up through multiple pump cycles; and a bleeder mechanism on the pressure side for bleeding-off the built-up pressure after the release of the closure capture.

27. The container of claim 26, wherein the bleeder mechanism is a bleeder valve which is shut during pressurization and open to the ambient after the release of the closure capture.

28. The container of claim 26, wherein the bleeder mechanism is a return passage in the one-way valve for permitting return from the pressure side to the pump side.

29. The container of claim 26, wherein the pressure pump is a hand operated squeeze bulb with an exhaust-pump cycle and an intake-refill cycle; during the exhaust-pump cycle, the one-way permits forward flow from the squeeze bulb pump forward to the release device; and during the intake-refill cycle, the one-way valve prevents return flow from the release device back to the squeeze bulb pump.

30. The container of claim 1, wherein:

the closure capture is at least one discrete closure latch, having a latched condition in which the closure shells are captured together in the closed state, and an unlatched condition in which the closure shells may be uncaptured in the accessible state; and the capture release device undergoes a shape-change displacement when changing from depressurized to pressurized, which displacement releases the closure latch from the latched condition to the unlatched condition.

31. The container of claim 30, wherein the discrete closure latch further comprises a plurality of discrete closure latches positioned around the perimeter of the opposed closure shells.

32. The container of claim 30, wherein the discrete closure latch further comprises: a resilient prong with a hooking face extending from one closure shell; and a holding face formed on the other closure shell for engaging the hooking face when the discrete latch is in the latched condition.

33. The container of claim 32, wherein the shape-change release device is installed on the other closure shell and pushes against the resilient prong during the shape-change displacement to disengage the faces and release the discrete closure latch.

* * * * *